US011261056B2

(12) United States Patent
Fauconnet et al.

(10) Patent No.: US 11,261,056 B2
(45) Date of Patent: Mar. 1, 2022

(54) ELEVATOR SAFETY ACTUATOR SYSTEMS

(71) Applicant: Otis Elevator Company, Farmington, CT (US)

(72) Inventors: Aurelien Fauconnet, Isdes (FR); Franck Rivoiret, Les bordes (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 175 days.

(21) Appl. No.: 16/715,509

(22) Filed: Dec. 16, 2019

(65) Prior Publication Data

US 2020/0198931 A1 Jun. 25, 2020

(30) Foreign Application Priority Data

Dec. 20, 2018 (EP) ..... 18306757

(51) Int. Cl.
*B66B 5/22* (2006.01)
*B66B 17/12* (2006.01)
*B66B 5/12* (2006.01)

(52) U.S. Cl.
CPC ..... *B66B 5/22* (2013.01); *B66B 5/12* (2013.01); *B66B 17/12* (2013.01)

(58) Field of Classification Search
CPC .... B66B 5/12; B66B 5/16; B66B 5/22; B66B 17/12
See application file for complete search history.

(56) References Cited

U.S. PATENT DOCUMENTS 301,586 A * 7/1884 Giles ..... B66B 5/22 187/372
505,289 A * 9/1893 Finney ..... B66B 5/26 187/372
837,253 A * 11/1906 Secoy ..... B66B 5/22 187/372

(Continued)

FOREIGN PATENT DOCUMENTS

CN 101143671 A 3/2008
CN 102030234 A 4/2011

(Continued)

OTHER PUBLICATIONS

European Search Report for European Application No. 18306757.8, International Filing Date Dec. 20, 2018, dated Aug. 22, 2019,11 pages.

(Continued)

*Primary Examiner* — Minh Truong
(74) *Attorney, Agent, or Firm* — Cantor Colburn LLP

(57) ABSTRACT

Counterweights for elevator systems are described. The counterweights include a frame and a counterweight safety system attached to the frame. The safety system includes a safety brake mounted to an upright of the frame and configured to enable engagement with a guide rail to apply a braking force. A sheave is mounted to the frame and configured to operably connect to tension members. The sheave is configured to move between a first position when under tension and a second position when the tension is lost. A connecting link operably connects the sheave to the safety brake. The connecting link has first and second link members operably connected between the sheave and the safety brake.

17 Claims, 7 Drawing Sheets

(56) References Cited

U.S. PATENT DOCUMENTS

| | | | | |
|---|---|---|---|---|
| 996,050 | A * | 6/1911 | Bisceglia et al. | B66B 5/22 187/372 |
| 1,178,942 | A * | 4/1916 | Pero et al. | B66B 5/22 187/372 |
| 5,495,919 | A | 3/1996 | Ericson et al. | |
| 6,758,310 | B2 | 7/2004 | Muff et al. | |
| 7,475,756 | B2 | 1/2009 | Maury et al. | |
| 8,668,055 | B2 | 3/2014 | Spirgi | |
| 9,027,714 | B2 | 5/2015 | Husmann et al. | |
| 9,309,091 | B2 | 4/2016 | Husmann | |
| 9,457,990 | B2 | 10/2016 | Osmanbasic et al. | |
| 9,546,074 | B2 | 1/2017 | Okamoto et al. | |
| 9,809,420 | B2 | 11/2017 | Fauconnet et al. | |
| 9,850,094 | B2 | 12/2017 | Husmann | |
| 2021/0188596 | A1* | 6/2021 | Fauconnet | B66B 5/18 |

FOREIGN PATENT DOCUMENTS

| | | | |
|---|---|---|---|
| CN | 203158966 | U | 8/2013 |
| CN | 104555646 | A | 4/2015 |
| CN | 105731211 | B | 9/2017 |
| CN | 108328453 | A | 7/2018 |
| CN | 208454243 | U | 2/2019 |
| CN | 110526094 | A | 12/2019 |
| CN | 111278758 | A | 6/2020 |
| CN | 111302181 | A | 6/2020 |
| CN | 210944451 | U | 7/2020 |
| CN | 210944475 | U | 7/2020 |
| CN | 211283320 | U | 8/2020 |
| CN | 212127172 | U | 12/2020 |
| CN | 112723085 | A | 4/2021 |
| CN | 213011417 | U | 4/2021 |
| EP | 1447369 | B1 | 7/2008 |
| EP | 1514826 | B1 | 9/2010 |
| EP | 1616831 | B1 | 3/2011 |
| EP | 2408703 | A1 | 1/2012 |
| EP | 2352689 | B1 | 4/2013 |
| EP | 2651810 | B1 | 3/2015 |
| EP | 2651808 | B1 | 3/2016 |
| EP | 2828188 | B1 | 5/2017 |
| EP | 1741659 | B1 | 6/2018 |
| EP | 3670416 | A1 | 6/2020 |
| JP | S4214194 | Y1 | 8/1967 |
| JP | S4984859 | U | 7/1974 |
| JP | S6371176 | U | 5/1988 |
| JP | 3776393 | B2 | 5/2006 |
| JP | 2010202323 | A | 9/2010 |
| WO | 2006082460 | A1 | 8/2006 |

OTHER PUBLICATIONS

Unidirectional Progressive Safety Gear for Counterweight Frame Application. WCWSG Apr. 2010. Wittur. Safety in Motion. Retrieved Nov. 15, 2018 from https://www.wittur.com/en/elevator-components/safety-devices/wcwsg-0410.aspx. 4 Pages.

* cited by examiner

ELEVATOR SAFETY ACTUATOR SYSTEMS

CROSS REFERENCE TO RELATED APPLICATIONS

This application claims the benefit of European Application No. 18306757.8, filed Dec. 20, 2018, which is incorporated herein by reference in its entirety.

BACKGROUND

The subject matter disclosed herein generally relates to elevator systems and, more particularly, to safety systems for elevators and control thereof in the event of overspeeding, specifically for counterweights of elevators.

Counterweights with safeties are typically provided and an option for elevator systems where the elevator shaft or hoistway extends below the pit floor (e.g., car parking). Two main types of safety actuation module exist for counterweights. First is a typical or conventional governor-and-tension device system, and the other is a slack-rope system (typically only employed for speeds of approximately 1 m/s).

A governor overspeed system may be coupled to a mechanical safety actuation module which in turn is connected to one or more safety brakes that activate in the event of a traveling component overspeed event. As used herein the term traveling component may refer to an elevator car, counterweight, or other device/structure that is moveable within an elevator system. Further, an overspeed event, as used herein, refers to excessive speed, acceleration, or unanticipated movement (e.g., free fall) of a traveling component. The governor overspeed system is configured to stop a traveling component that is travelling too fast. Such safety actuation modules include a linking mechanism to engage two or more car safety brakes simultaneously (i.e., on both guide rails). The governor is located either in a machine room, in the hoistway, or may be mounted to the traveling component. The safety actuation module is typically made of a linkage that spans the width of the traveling component to link opposing sides at the guide rails.

A slack rope system may operate based on tension applied to belts or ropes of a counterweight being released. As the tension is released, the belts or ropes will go slack, thus causing a trigger of the overspeed safety system (e.g., triggering application of safety brakes). Such systems rely upon a member that connects the elements responsive to the slack rope to the safety brake. Improved slack rope systems may be beneficial to improve the life of such systems.

BRIEF SUMMARY

According to some embodiments, counterweights for elevator systems are provided. The counterweights include a frame, the frame having uprights and a frame member extending between the uprights and a counterweight safety system attached to the frame. The counterweight safety system includes a safety brake mounted to an upright of the frame, the safety brake configured to enable engagement with a guide rail and apply a braking force to the counterweight when activated, a sheave mounted to the frame member, the sheave configured to operably connect to one or more tension members, the sheave configured to move between a first position when under tension by connected tension members and a second position when the tension is lost, and a connecting link operably connecting the sheave to the safety brake. The connecting link includes a first link member movably connected to the sheave at a first end by a primary pivot and connected to a secondary pivot at a second end and a second link member movably connected to the second end of the first link member about the secondary pivot, wherein the second link is operably connected to the safety brake and configured to activate the safety brake when transitioned from a first position to a second position of the second link member.

In addition to one or more of the features described above, or as an alternative, further embodiments may include that the connecting link further has a third link member operably connecting the second link member to the safety brake.

In addition to one or more of the features described above, or as an alternative, further embodiments may include that the primary pivot is moveable relative to the frame member from a first position when the sheave is under tension to a second position when the sheave is not under tension.

In addition to one or more of the features described above, or as an alternative, further embodiments may include a primary biasing element arranged to urge the primary pivot toward the first position.

In addition to one or more of the features described above, or as an alternative, further embodiments may include a secondary biasing element arranged between the first link member and the second link member, the secondary biasing element configured to urge the second link member into the first position.

In addition to one or more of the features described above, or as an alternative, further embodiments may include a sheave support movably mounted to the frame member, wherein the sheave is supported on the sheave support.

In addition to one or more of the features described above, or as an alternative, further embodiments may include a frame stop fixedly connected to the frame member and a sheave connector, wherein the sheave connector is configured to move relative to the frame stop when the sheave loses tension.

In addition to one or more of the features described above, or as an alternative, further embodiments may include one or more weight elements supported by the frame.

In addition to one or more of the features described above, or as an alternative, further embodiments may include one or more guide shoes configured to engage with the guide rail.

In addition to one or more of the features described above, or as an alternative, further embodiments may include that the frame member is an upper frame member of the frame.

In addition to one or more of the features described above, or as an alternative, further embodiments may include that the secondary pivot is fixedly attached to the frame member.

In addition to one or more of the features described above, or as an alternative, further embodiments may include that the first link and the second link move together when the sheave moves from the first position to the second position and wherein the first link and the second link move independently when the sheave moves from the second position to the first position.

According to some embodiments, elevator systems having the counterweight of any of the above described embodiments are provided.

In addition to one or more of the features described above, or as an alternative, further embodiments of the elevator systems may include an elevator car operably connected to the counterweight by one or more tension members.

In addition to one or more of the features described above, or as an alternative, further embodiments of the elevator systems may include a guide rail, wherein the safety brake of the counterweight is configured to engage with the guide rail to apply a braking force to the counterweight when traveling along the guide rail.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited by the accompanying figures in which like reference numerals indicate similar elements.

DETAILED DESCRIPTION

Figure 1:
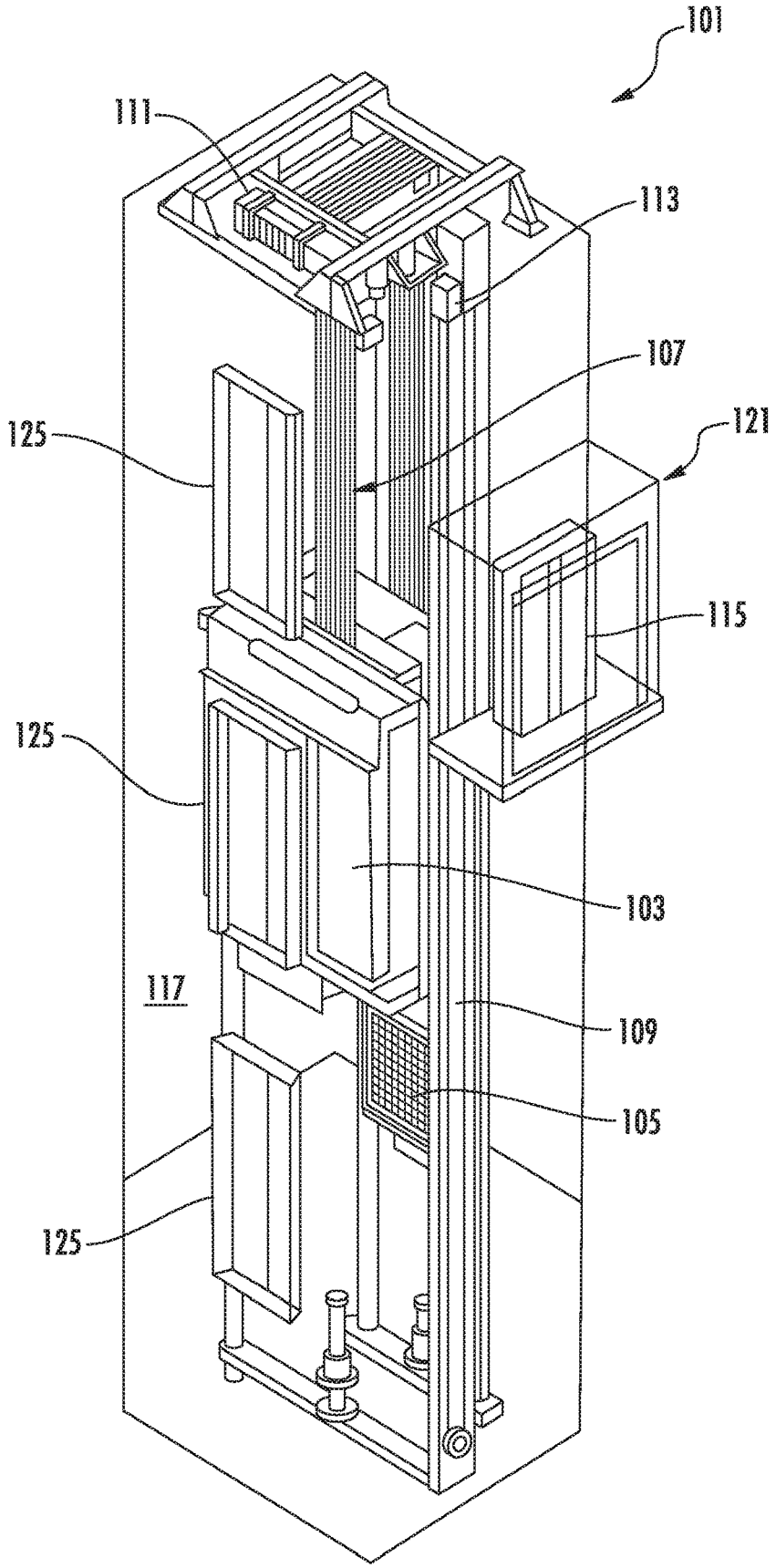
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and an elevator controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and passengers and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counterweight, as known in the art. For example, without limitation, the position reference system 113 can be an encoder, sensor, or other system and can include velocity sensing, absolute position sensing, etc., as will be appreciated by those of skill in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position reference system 113 or any other desired position reference device. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Embodiments of the present disclosure are directed to slack-rope safety systems for counterweights. As noted above, current slack-rope systems actuate based on a loss of tension in a suspension member (e.g., tension member 107). This is further aided by a weight of a counterweight sheave in order to activate a rigid connecting link that will cause safety brakes to be applied. As will be appreciated by those of skill in the art, the sheave will move down by gravity (e.g., due to the loss of tension on the tension member) and will mechanically activate connection rods or links of the safety actuation module and consequently trigger operation the safety brakes. After a safety actuation occurs (e.g., due to an overspeed event), there are two typical solutions to release the brakes of the counterweight safety system.

One method is to use the elevator machine. In such instances, the safety actuation module is specifically designed to support severe or extreme load cases (i.e., disengagement force plus the weight of various components of the system). As such, this solution requires a very robust (e.g., strong and costly) safety actuation module for the counterweight. Another solution employs a "rail grabber" tool and a "winch" that are provided on job site in order to perform the reset of the counterweight safety system essentially manually.

Embodiments of the present disclosure are directed to incorporating a flexible element or configuration in the link between a counterweight sheave and a counterweight safety brake. For example, a hinged link may be provided between a counterweight sheave and safety brakes of the counterweight. The hinged link will cause a reduction in forces acting upon the connecting link both during safety brake operation (e.g., during an overspeed event) and during a reset operation of the system.

Figure 2:
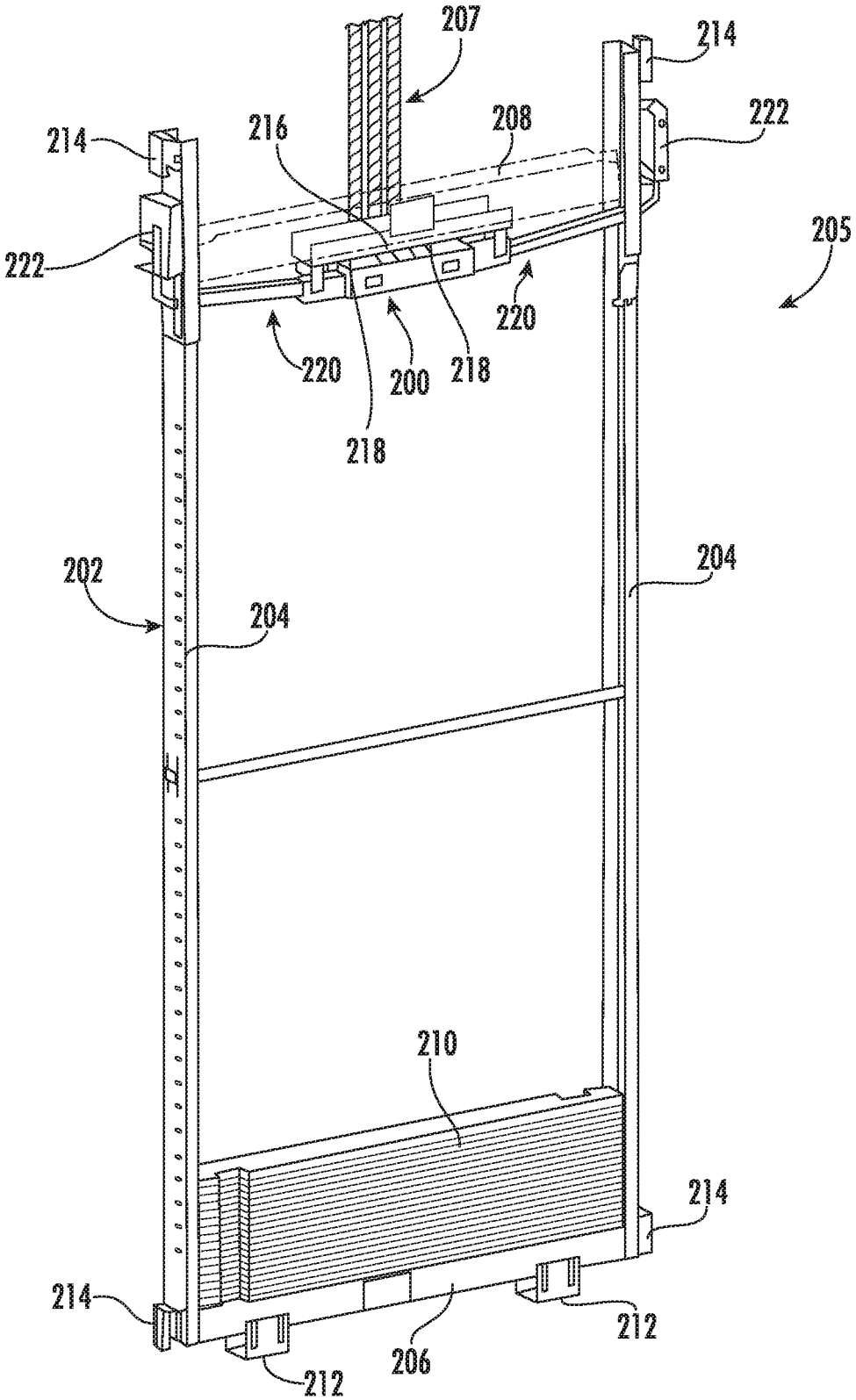
FIG. 2 is a schematic illustration of a counterweight having a counterweight safety system in accordance with an embodiment of the present disclosure.

Turning now to FIG. 2, a counterweight 205 having a counterweight safety system 200 in accordance with an embodiment of the present disclosure is shown. The counterweight 205 may be operably connected to an elevator car, as shown and described above, and may be suspended on one or more tension members 207. The counterweight safety system 200 is a slack-rope configuration such that if the tension in the tension members 207 goes slack, the counterweight safety system 200 may activate to apply a braking force to the counterweight 205.

The counterweight 205 includes a frame 202 having uprights 204, a base or lower frame member 206, and an upper frame member 208. The lower and upper frame members 206, 208 are connected to the uprights 204 to form the frame 202, as will be appreciated by those of skill in the art. One or more weight elements 210 are arranged and supported by the lower frame member 206. Additionally, one or more buffers 212 may be arranged on the lower frame member 206 to provide a buffer or impact or contact element for contact with a pit floor, if needed. The weight elements 210 are provided to generate a counterweight or force for operation of an elevator system. For example, the counterweight 205 may be operably connected to an elevator car or elevator machine by the tension members 207, and the weight of the weight elements 210 may be selected for operation of the elevator system. The uprights 204 may include one or more guide shoes 214 (e.g., at the top/bottom or ends thereof). The guide shoes 214 are configured to slideably engage with a guide rail, as will be appreciated by those of skill in the art. The counterweight 205 further includes a sheave 216 that is mounted to the upper frame member 208 and operably connects the counterweight 205 to the tension members 207, as known in the art.

The counterweight safety system 200 includes sheave engagement portions 218, connecting links 220, and safety brakes 222. The sheave engagement portions 218 are configured to respond to a loss in tension of the tension members 207. For example, in some embodiments, and as described below, the sheave engagement portions 218 may be biased or spring-loaded elements that will actuate when a retaining force is reduced thereon (e.g., the tension members 207 no longer pull upward upon the sheave 216). Operably connected to the sheave engagement portions 218 are the connecting links 220. The connecting links 220 are operably connected to the safety brakes 222. The connecting links 220 are operable, by action of the sheave engagement portions 218, to cause engagement (or disengagement) of the safety brakes 222. The safety brakes 222 are configured with wedges, rollers, or other elements that are engageable with a guide rail to apply a braking force to the movement of the counterweight 205.

Figure 3A:
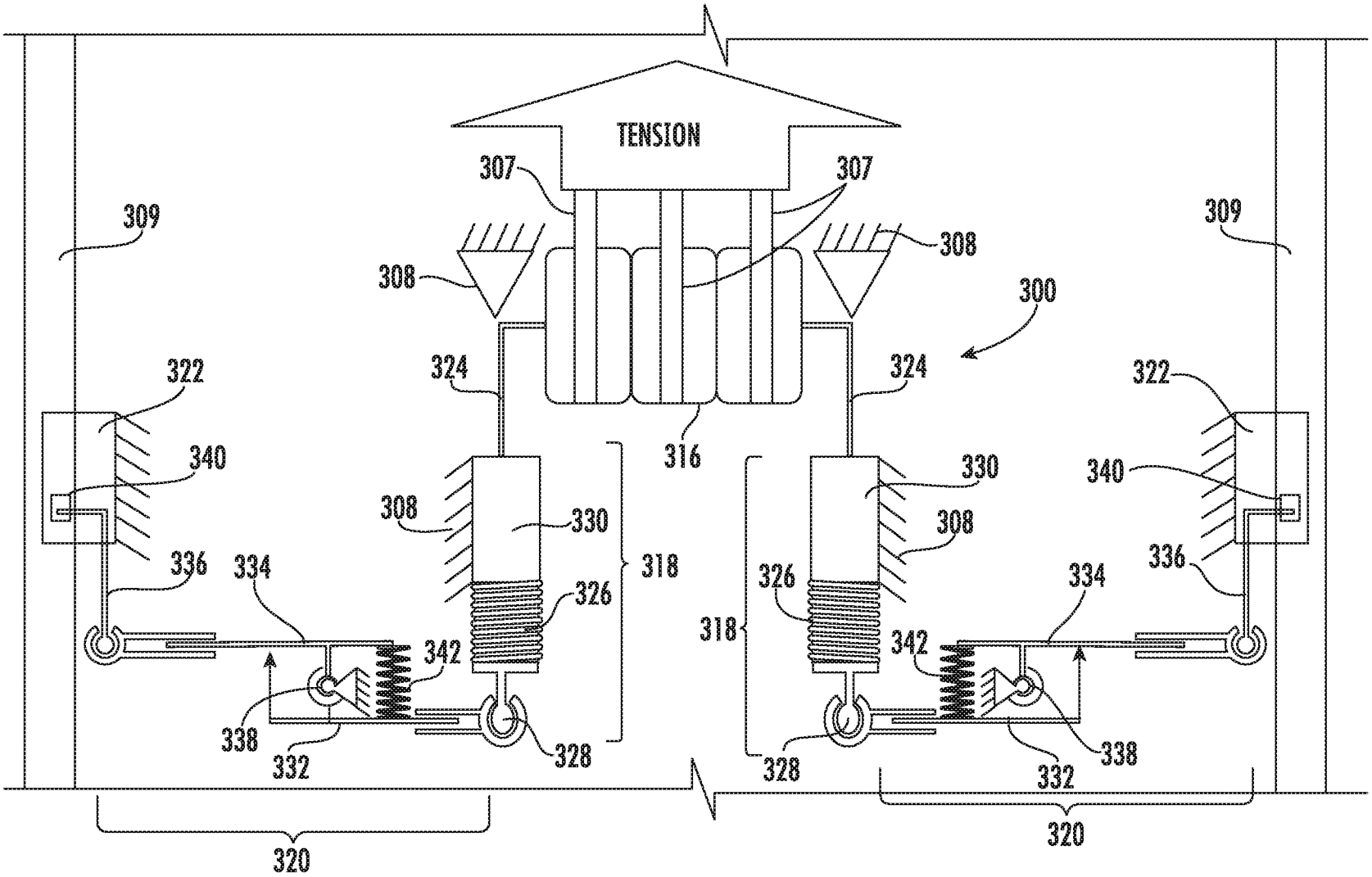
FIG. 3A is a schematic illustration of a counterweight safety system in accordance with an embodiment of the present disclosure, shown in a first or normal operation state.
Figure 3B:
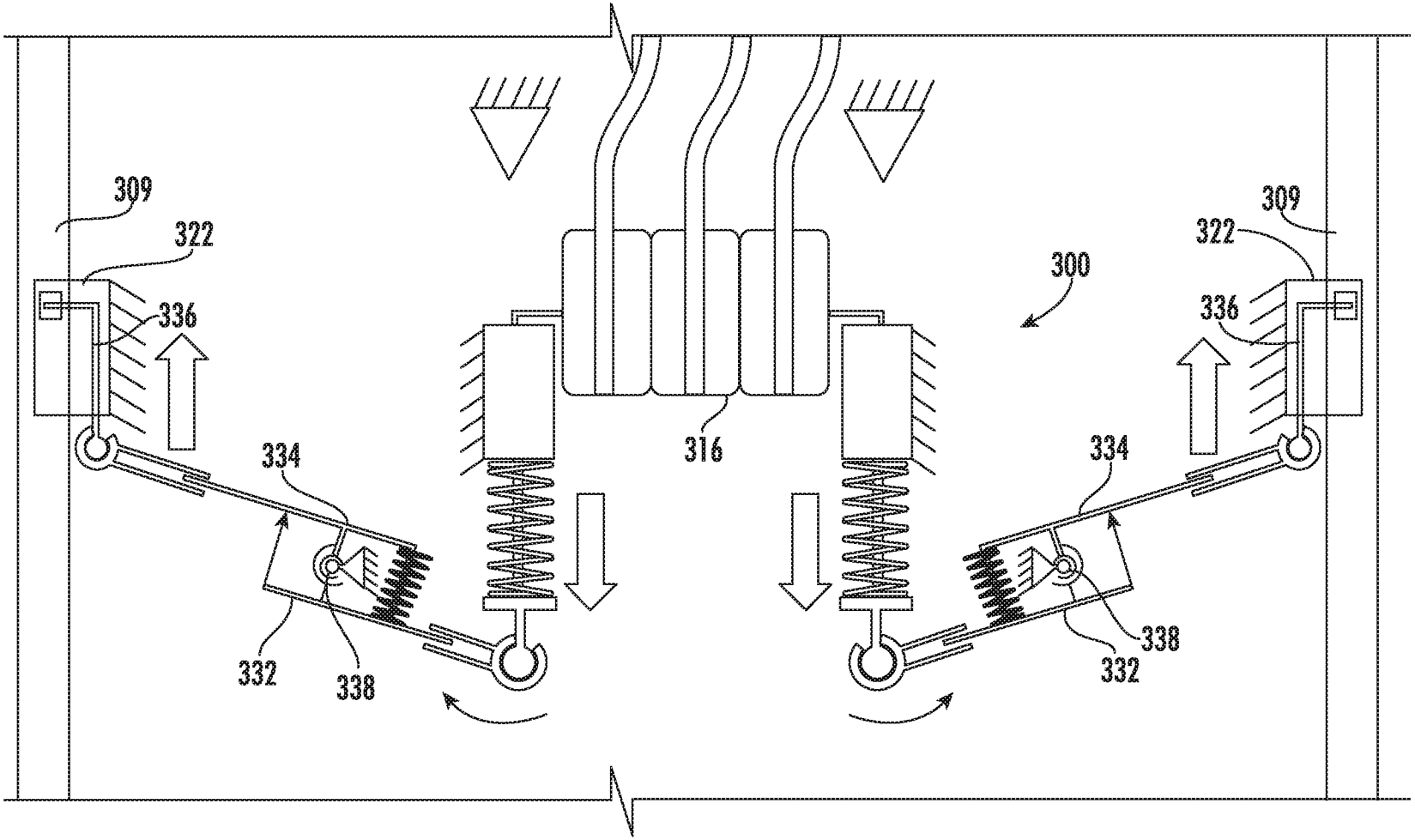
FIG. 3B is a schematic illustration of the counterweight safety system of FIG. 3A shown in a second or activated operation state.
Figure 3C:
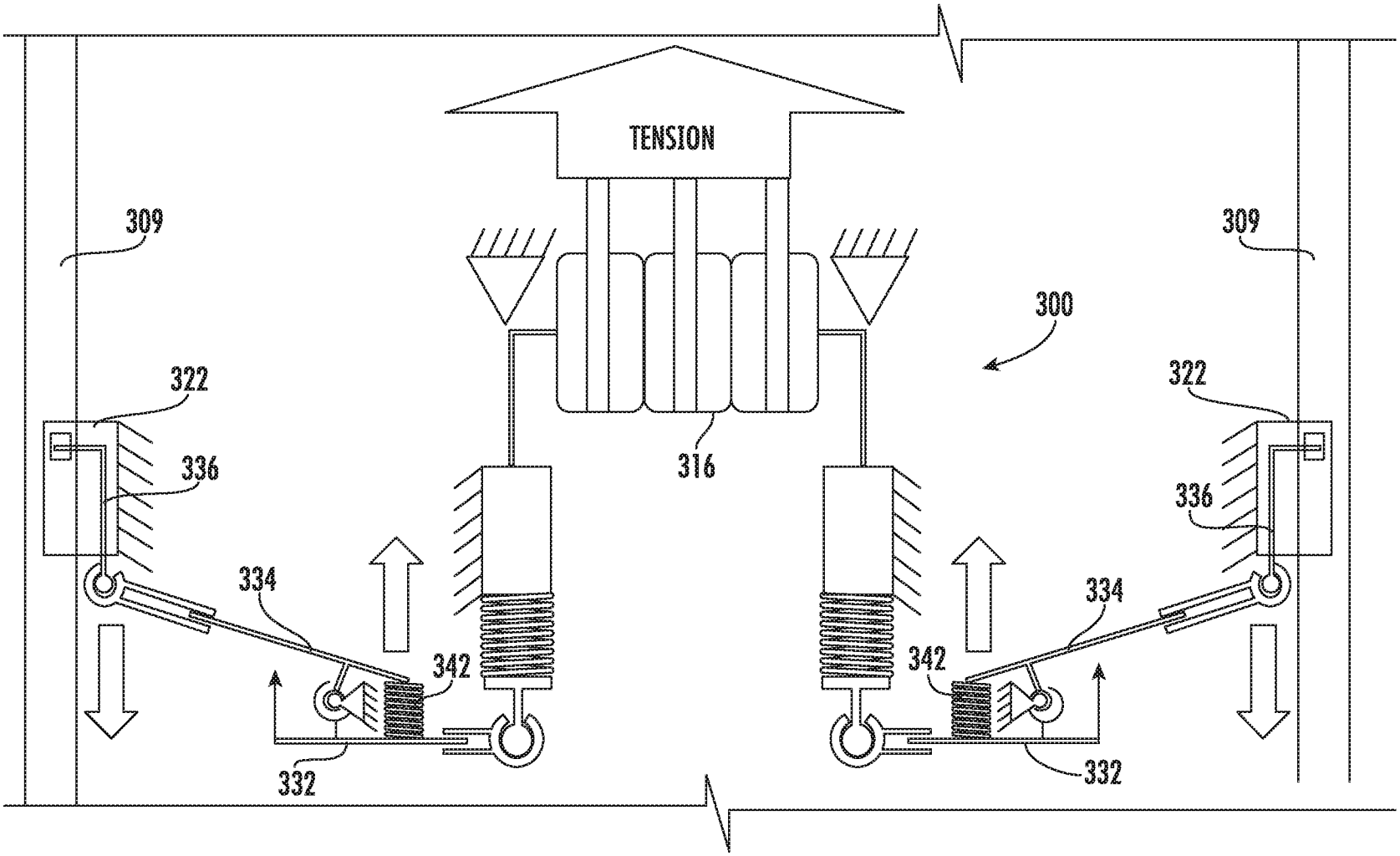
FIG. 3C is a schematic illustration of the counterweight safety system of FIG. 3A illustrating a transition from the second state to the first state to perform a resetting of the counterweight safety system.

Turning now to FIGS. 3A-3C, schematic illustrations of operation of a counterweight safety system 300 in accordance with an embodiment of the present disclosure are shown. FIG. 3A illustrates the counterweight safety system 300 during normal operation. FIG. 3B illustrates the counterweight safety system 300 during a safety actuation operation. FIG. 3C illustrates a reset operation or release operation of the counterweight safety system 300 after a safety actuation operation. Because FIGS. 3A-3C illustrate different functional states of the same structure, certain features may not be labeled multiple times for clarity in the specific illustrations. However, it is to be understood that each of the configurations of FIGS. 3A-3C contain the same components and features.

As illustratively shown the counterweight safety system 300 includes two substantially identical arrangements of components that engage with respective guide rails 309. Although shown with two substantially identical arrangements, in some embodiments, only a single arrangement may be provided. Furthermore, depending on the configuration of the elevator system additional arrangements may be provided, without departing from the scope of the present disclosure. Accordingly, the present illustrative embodiments are provided as demonstrative of one configuration and application of a counterweight safety system of the present disclosure.

The counterweight safety system 300 is part of a counterweight (e.g., as shown in FIG. 2). A sheave 316 is mounted to an upper frame member 308 and operably couples with one or more tension members 307. The sheave 316 may be mounted to the upper frame member 308 by a moveable support, wherein the movable support is movable relative to the upper frame member 308. Thus, if tension in the tension members 307 is reduced, the movable support and the sheave 316 may move relative to the upper frame member 308. One non-limiting example of such configuration is shown and described below.

The sheave 316 is connected to the counterweight safety system 300 by sheave connectors 324. The sheave connectors 324 form part of sheave engagement portions 318 of the counterweight safety system 300. The sheave connectors 324 are fixedly or rigidly connected to the sheave 316 such that movement of the sheave 316 causes movement of the sheave connectors 324, or vice versa. The sheave engagement portions 318 include the sheave connectors 324, primary biasing elements 326, primary pivots 328, and frame stops 330. The frame stops 330 are fixedly or rigidly connected to the upper frame member 308 and the sheave connectors 324 are arranged to move relative to the frame stops 330. The biasing primary elements 326 are arranged along the sheave connectors 324 and are positioned between the frame stops 330 and the primary pivots 328, with the primary pivots 328 on an end of the sheave connectors 324.

The sheave engagement portions 318 are operably connected to connecting links 320. As shown, the primary pivots 328 provide connection to the connecting links 320. The connecting links 320 include a first link member 332, a second link member 334, and a third link member 336. The first and second link members 332, 334 allow for a relatively flexible or adjustable portion of the connecting link 320 to reduce stresses and forces acting upon the connecting link 320. The first link member 332 is operably connected to the primary pivot 328 such that movement of the sheave connector 324 causes movement of the first link member 332 (e.g., rotation about the primary pivot 328, shown in FIG. 3B).

The first link member 332 is operably connected to the second link member 334 about a secondary pivot 338. The secondary pivot 338 may be fixedly mounted to or attached to the upper frame member 308. Movement of the first link member 332 causes rotation about the secondary pivot 338, which causes the first link member 332 to apply force to the second link member 334 and thus rotate or pivot the second link member 334 about the secondary pivot 338. As the second link member 334 is moved, the second link member 334 will apply force to the third link member 336. The third link member 336 is operably connected to or coupled to a safety brake 322. For example, the third link member 336 may transition a brake wedge 340 from a first position (FIG. 3A, normal operation) to a second position (FIG. 3B, braking operation) to apply a braking force through engagement of the brake wedges 340 to guide rails 309.

To reset the counterweight safety system 300 after activation (shown in FIG. 3B), tension is reapplied to the sheave 316, which reverses the movement of the link members 332, 334, 336, thus disengaging the safety brakes 322 from the guide rails 309 (as shown in FIG. 3C).

The counterweight safety system of embodiments provided herein enables a reduction of forces that can impact the viability, strength, useful life, etc. of various components of a counterweight safety system. For example, because of the inclusion of the primary and secondary pivots 328, 338, and the connecting link 320 being formed from multiple link members 332, 334, 336, no single component of the counterweight safety system 300 may be subject to extreme or excessive forces during a safety actuation or a reset of the counterweight safety system. The actuation may be provided by a stepped approach, specifically achieved through application of forces from operably connected link members. Because each of the link members (particularly first and second link members 332, 334) may be movable at least partially independently from each other, extreme forces may be minimized or eliminated. For example, as shown in FIG. 3C, during a reset process, the first link member 332 may be returned to the normal operating position (similar to that shown in FIG. 3A), and the second link member 334 may transition back to normal position independently. The transition of the second link member 334 from the activated position (FIG. 3B) to the normal position (FIG. 3A) may be achieved by a downward force applied by the safety brakes 322 (relative to an upward movement of the upper frame member 308).

The counterweight safety system 300 may further include a secondary biasing element 342. The secondary biasing element 342 may be arranged to aid in the resetting operation of the counterweight safety system 300. For example, the secondary biasing element 342 may be biased to urge the second link member 334 into or toward the normal operating position (FIG. 3A) and it is the pivoting and application of force by the first link member 332 that overcomes the force of the secondary biasing element 342 to perform a safety braking operation. Once the first link member 332 is returned to the normal operation state (shown in FIGS. 3A and 3C), the secondary biasing element 342, separately or in combination with force applied by the third link member 336, may cause the second link member 334 to return to the normal operating position (FIG. 3A). The secondary biasing element 342 may alternatively and/or additionally be configured to prevent false tripping of the counterweight safety system 300. For example, the second link member 334 may move some distance during normal operation due to various factors. However, an overspeed event may not always occur during such movement. Accordingly, the secondary biasing element 342 may be provided to maintain or urge the second link member 334 into the normal position (FIG. 3A) and thus prevent false or unintended braking by the counterweight safety system 300.

Figure 4A:
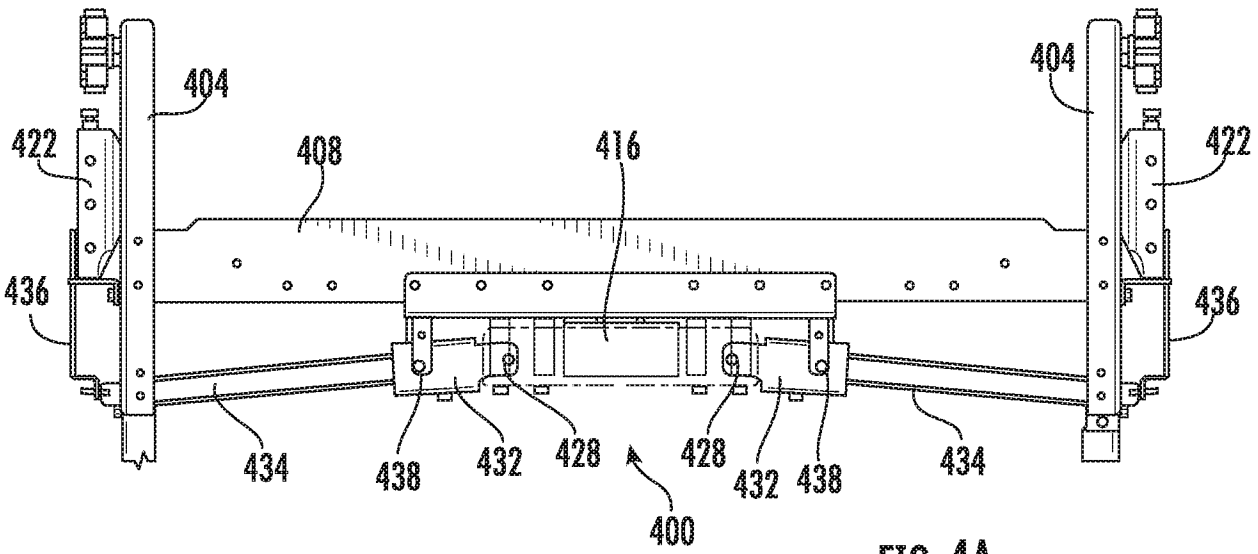
FIG. 4A is a schematic illustration of a counterweight safety system in accordance with an embodiment of the present disclosure, shown in a first or normal operation state.
Figure 4B:
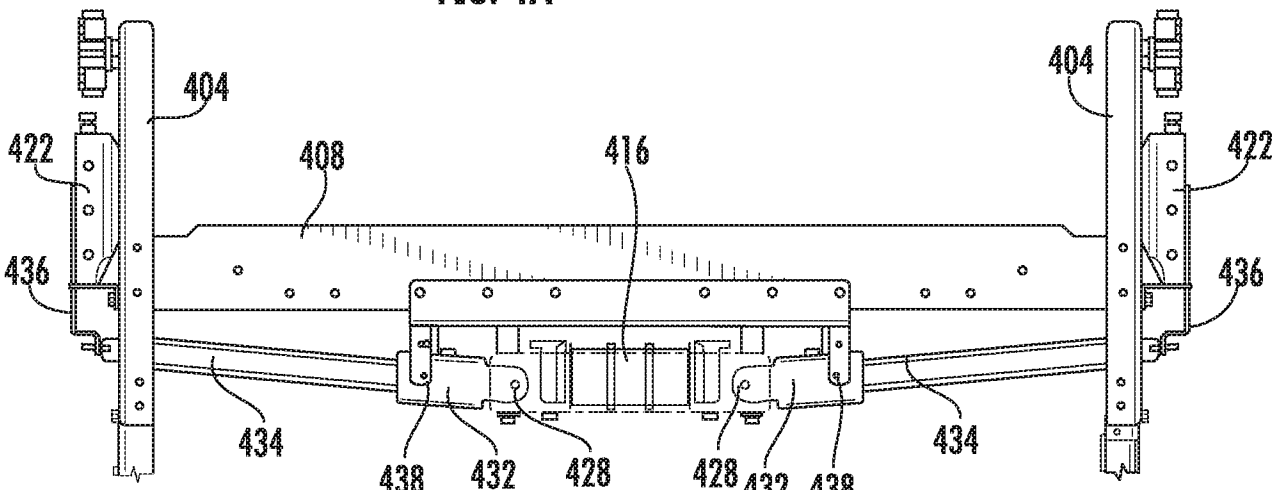
FIG. 4B is a schematic illustration of the counterweight safety system of FIG. 4A shown in a second or activated operation state.

Turning now to FIGS. 4A-4B, schematic illustrations of a counterweight safety system 400 in accordance with an embodiment of the present disclosure are shown. The counterweight safety system 400 may be similar in construction and operation as that shown and described above with respect to FIGS. 3A-3C. FIG. 4A illustrates the counterweight safety system 400 in a normal operating position or state. FIG. 4B illustrates the counterweight safety system 400 in an activated or braking position or state.

The counterweight safety system 400 is part of a counterweight, as described above, and is mounted and arranged with respect to an upper frame member 408 of a frame of the counterweight. The counterweight safety system 400 operates safety brakes 422 which are configured to engage with guide rails of an elevator system. The safety brakes 422 are mounted to uprights 404 of the frame of the counterweight. The counterweight includes a sheave 416 that is operably connected to one or more tension members of the elevator system, as shown and described above.

The counterweight frame supports the sheave 416 and the counterweight safety system 400. As described above, the counterweight safety system 400 is operably connected to the sheave 416 such that a loss in tension to the sheave 416 will cause the counterweight safety system 400 to activate and apply a braking force by activating and/or actuating the safety brakes 422 into engagement with guide rails.

The counterweight safety system 400 includes a primary pivot 428 and a secondary pivot 438 with a first link member 432 arranged therebetween. A second link member 434 is connected to the secondary pivot 438 and is moveable about the secondary pivot by movement of the first link member 432. The second link member 434 is operably connected to a third link member 436, which in turn is operably connected to the safety brake 422. As shown in FIG. 4A, the third link member 436 is arranged downward relative to the safety brake 422 and in such a position that the safety brake 422 is not engaged with a guide rail to apply a braking force. FIG. 4B illustrates the activated state where the third link member 436 has been moved upward relative to the safety brake 422 (forced by movement of the second link member 434) and causing the safety brake 422 to engage with a guide rail and apply a braking force to the counterweight.

As shown illustratively in FIG. 4B, as compared to FIG. 4A, the sheave 416 has moved downward relative to the upper frame member 408, which is caused by a loss of tension on the sheave 416. When the sheave 416 moves downward relative to the upper frame member 408, the primary pivot 428 will also be moved downward relative to the upper frame member 408. When the primary pivot 428 moves downward, it will cause the first link member 432 to transition from a first position or state (shown in FIG. 4A) to a second position or state (shown in FIG. 4B). As shown, the first link member 432 pivots or rotates relative to the primary pivot 428. As the first link member 432 rotates or pivots about the primary pivot 428, the first link member 432 will apply force to the second link member 434 and thus transition the second link member 434 from a first position or state (shown in FIG. 4A) to a second position or state (shown in FIG. 4B). As the second link member 434 moves upward into the second position, the second link member 434 urges the third link member 434 to move upward and operate the safety brake 422.

After activated, the counterweight safety system 400 may be reset as described above, with the tension reapplied to the sheave 416, which urges the sheave 416 upward and toward the upper frame member 408. As this transition occurs, the first link member 432 will transition from the second position (FIG. 4B) back to the first position (FIG. 4A). This transition may be added by a primary biasing element, as described above. Further, as the counterweight moves upward relative to the guide rails, due to tension applied thereto, the safety brakes 422 will disengage from the guide rails, and the third link member 436 will move downward relative to the safety brake 422. As the third link member 436 moves downward, it will cause the second link member 434 to transition from the second position (FIG. 4B) back to the first position (FIG. 4A). This transition may be added by a second biasing element, as described above.

Figure 5:
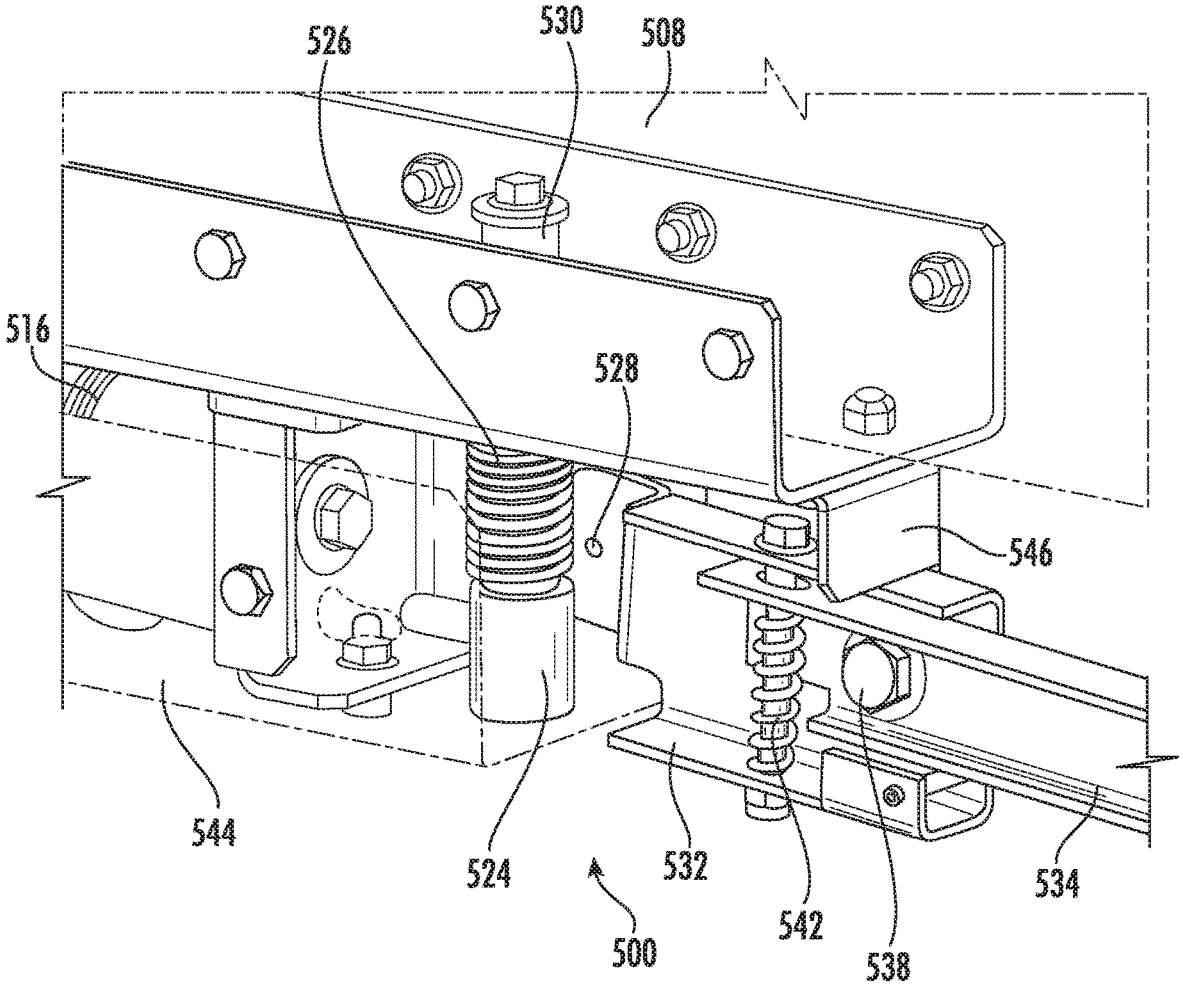
FIG. 5 is an enlarged schematic of a portion of a counterweight safety system in accordance with an embodiment of the present disclosure.

Turning now to FIG. 5, an enlarged portion of a counterweight safety system 500 in accordance with an embodiment of the present disclosure is shown. The counterweight safety system 500 may be similar to that shown and described above. As shown, a sheave 516 is mounted to an upper frame member 508. In this illustration, the sheave 516 is mounted to a sheave support 544 that in turn is moveably mounted to the upper frame member 508, although such sheave support 544 may be optional depending on the specific counterweight configuration. The moveable connection between the sheave support 544 and the upper frame member 508 is provided by a sheave connector 524 and a frame stop 530, with a primary biasing element 526 operably coupled therebetween. The primary biasing element 526 is maintained under compression or pressure when the sheave 516 is under tension. However, when tension is released on the sheave 516, the primary biasing element 526 will urge the sheave connector 524 downward relative to the upper frame member 508.

Pivotably connected to the sheave support 544 (or the sheave 516 in some embodiments) is a first link member 532, as described above. The connection between the first link member 532 and the sheave support 544 is at or by a primary pivot 528 at a first end, as described above. The first link member 532 is connected at a second end to a second link member 534 by a secondary pivot 538. The secondary pivot 538 is fixedly attached or connected to the upper frame member 508 by a pivot support 546. Thus, as the sheave support 544 moves downward after a loss of tension on the sheave 516, the first link member 532 will be urged downward at its first end by the primary pivot 528 and thus pivot about the secondary pivot 538 at its second end. During movement or rotation of the first link member 532, the first link member 532 will contact the second link member 534 and urge the second link member 534 to move or rotate, as described above. A secondary biasing element 542 is arranged at the connection between the first link member 532 and the second link member 534, and is arranged and configured to operate as described above (e.g., apply a resetting force and/or prevent unintended operation of the counterweight safety system 500.

Although shown and described with the counterweight safety system attached to an upper frame member of the frame of the counterweight, such configuration is not to be limiting, but rather is provided for illustrative and explanatory purposes. In alternative embodiments, the counterweight safety systems of the present disclosure may be connected to mid-span frame members, or even the lower frame member, depending on the configuration of the counterweight frame and/or the elevator system.

Advantageously, embodiments described herein provide overspeed safety systems that can provide controlled stopping of a counterweight in the event of an overspeed event. Embodiments described herein and variations thereof enable reliable lifting forces to act upon safety brakes through the application of a connecting link that is configured as a plurality of link members. Advantageously, embodiments provided herein may enable a reduction in total weight of a counterweight and/or counterweight safety system.

The terminology used herein is for the purpose of describing particular embodiments only and is not intended to be limiting of the present disclosure. The term "about" is intended to include the degree of error associated with measurement of the particular quantity and/or manufacturing tolerances based upon the equipment available at the time of filing the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A counterweight for an elevator system, the counterweight comprising:

a frame, the frame having uprights and a frame member extending between the uprights; and a counterweight safety system attached to the frame, the counterweight safety system comprising:

a safety brake mounted to an upright of the frame, the safety brake configured to enable engagement with a guide rail and apply a braking force to the counterweight when activated;

a sheave mounted to the frame member, the sheave configured to operably connect to one or more tension members, the sheave configured to move between a first position when under tension by connected tension members and a second position when the tension is lost; and a connecting link operably connecting the sheave to the safety brake, wherein the connecting link comprises:

a first link member movably connected to the sheave at a first end by a primary pivot and connected to a secondary pivot at a second end; and a second link member movably connected to the second end of the first link member about the secondary pivot, wherein the second link is operably connected to the safety brake and configured to activate the safety brake when transitioned from a first position to a second position of the second link member; and a secondary biasing element arranged between the first link member and the second link member, the secondary biasing element configured to urge the second link member into the first position; wherein the first link and the second link move together when the sheave moves from the first position to the second position and wherein the first link and the second link move independently when the sheave moves from the second position to the first position.

2. The counterweight of claim 1, the connecting link further comprising a third link member operably connecting the second link member to the safety brake.

3. The counterweight of claim 1, wherein the primary pivot is moveable relative to the frame member from a first position when the sheave is under tension to a second position when the sheave is not under tension.

4. The counterweight of claim 3, further comprising a primary biasing element arranged to urge the primary pivot toward the second position.

5. The counterweight of claim 1, further comprising a sheave support movably mounted to the frame member, wherein the sheave is supported on the sheave support.

6. The counterweight of claim 1, further comprising:

a frame stop fixedly connected to the frame member; and a sheave connector, wherein the sheave connector is configured to move relative to the frame stop when the one or more tension members lose tension.

7. The counterweight of claim 1, further comprising one or more weight elements supported by the frame.

8. The counterweight of claim 1, further comprising one or more guide shoes configured to engage with the guide rail.

9. The counterweight of claim 1, wherein the frame member is an upper frame member of the frame.

10. The counterweight of claim 1, wherein the secondary pivot is fixedly attached to the frame member.

11. An elevator system comprising:

a counterweight having a frame, the frame having uprights and a frame member extending between the uprights; and a counterweight safety system attached to the frame, the counterweight safety system comprising:

a safety brake mounted to an upright of the frame, the safety brake configured to enable engagement with a guide rail and apply a braking force to the counterweight when activated;

a sheave mounted to the frame member, the sheave configured to operably connect to one or more tension members, the sheave configured to move between a first position when under tension by connected tension members and a second position when the tension is lost; and a connecting link operably connecting the sheave to the safety brake, wherein the connecting link comprises:

a first link member movably connected to the sheave at a first end by a primary pivot and connected to a secondary pivot at a second end; and a second link member movably connected to the second end of the first link member about the secondary pivot, wherein the second link is operably connected to the safety brake and configured to activate the safety brake when transitioned from a first position to a second position of the second link member; and a secondary biasing element arranged between the first link member and the second link member, the secondary biasing element configured to urge the second link member into the first position; wherein the first link and the second link move together when the sheave moves from the first position to the second position and wherein the first link and the second link move independently when the sheave moves from the second position to the first position.

12. The elevator system of claim 11, further comprising an elevator car operably connected to the counterweight by one or more tension members.

13. The elevator system of claim 11, further comprising a guide rail, wherein the safety brake of the counterweight is configured to engage with the guide rail to apply a braking force to the counterweight when traveling along the guide rail.

14. The elevator system of claim 11, the connecting link further comprising a third link member operably connecting the second link member to the safety brake.

15. The elevator system of claim 11, wherein the primary pivot is moveable relative to the frame member from a first position when the sheave is under tension to a second position when the sheave is not under tension.

16. The elevator system of claim 11, further comprising a sheave support movably mounted to the frame member, wherein the sheave is supported on the sheave support.

17. The elevator system of claim 11, further comprising:

a frame stop fixedly connected to the frame member; and a sheave connector, wherein the sheave connector is configured to move relative to the frame stop when the sheave loses tension.

* * * * *